United States Patent [19]

King

[11] Patent Number: 4,555,960

[45] Date of Patent: Dec. 3, 1985

[54] SIX DEGREE OF FREEDOM HAND CONTROLLER

[75] Inventor: Michael King, Amsterdam, Canada

[73] Assignee: CAE Electronics, Ltd., Montreal, Canada

[21] Appl. No.: 477,987

[22] Filed: Mar. 23, 1983

[51] Int. Cl.[4] ..... G05G 9/02

[52] U.S. Cl. ..... 74/471 XY; 73/862.05; 74/491; 74/523; 200/6 A; 244/236; 267/150; 338/128

[58] Field of Search ..... 74/471 XY, 491, 523; 73/862.04, 862.05; 200/6 A; 338/128; 244/234, 236, 237; 267/150

[56] References Cited

U.S. PATENT DOCUMENTS

| | | | |
|---|---|---|---|
| 3,260,826 | 7/1966 | Johnson | 200/157 |
| 3,296,882 | 1/1967 | Durand | 74/471 XY |
| 3,350,956 | 11/1967 | Monge | 74/471 XY |
| 3,409,252 | 11/1968 | Miller | 338/128 X |
| 3,561,263 | 2/1971 | Ward et al. | 73/862.05 |
| 3,771,037 | 11/1973 | Bailey, Jr. | 244/237 X |
| 4,012,014 | 3/1977 | Marshall | 74/471 XY X |
| 4,216,467 | 8/1980 | Colston | 74/471 XY X |
| 4,348,142 | 9/1982 | Figour | 244/236 X |
| 4,420,808 | 12/1983 | Diamond et al. | 73/862.05 |

FOREIGN PATENT DOCUMENTS

| | | | |
|---|---|---|---|
| 739505 | 6/1980 | U.S.S.R. | 74/471 XY |

*Primary Examiner*—Allan D. Herrmann

*Attorney, Agent, or Firm*—Fishman & Dionne

[57] ABSTRACT

The invention relates to a 6 degree of freedom hand controller. The hand controller includes a handgrip member which is substantially spherical in shape and which includes a point disposed substantially centrally of the member. An elongated shaft member supports the handgrip member such that the handgrip member is rotatable, from an initial position, about the point. The rotational motion of the handgrip member about the point is resolvable into motion about a pitch axis, passing through the point, a roll axis at right angles to the pitch axis and also passing through the point, and a yaw axis, at right angles to both the pitch axis and the roll axis and also passing through the point. The elongated shaft member is movably supported such that the handgrip member is movable, from the initial position, in translational motion resolvable into motion along the pitch, roll and yaw axes and through the point. Whereby, the rotational motion of the member comprises motion of the member about the point, and, whereby, the effective lines of thrust of the translational motion of the member pass through the point.

6 Claims, 7 Drawing Figures

SIX DEGREE OF FREEDOM HAND CONTROLLER

BACKGROUND OF INVENTION (a) Field of the Invention

The invention relates to a 6 degree of freedom hand controller. More specifically, the invention relates to such a controller having a substantially spherical handgrip member with a substantially central point therein, the handgrip member being rotatable about said point to input rotational motion, while, to input translational motion, the effective lines of thrust pass through the point.

(b) Description of Prior Art

Hand controllers for spacecraft flight and/or manipulator control are known in the art. Thus, U.S. Pat. No. 3,296,882, Durand, Jan. 10, 1967, teaches such a hand controller having a somewhat spherical grip member 26. However, the grip member of the Durand patent is not mounted for rotational movement relative to its support shaft 25.

U.S. Pat. No. 3,260,826, Johnson, July 12, 1966, teaches a 6 degree of freedom hand controller. However, the handgrip member of the Johnson patent constitutes a cylindrical member rather than a spherical member.

U.S. Pat. No. 3,350,956, Monge, Nov. 7, 1967, also teaches a 6 degree of freedom hand controller. However, once again, the handgrip member 2 is not mounted for rotation relative to its support shaft 3. In addition, the system taught by Monge is complicated and requires a good deal of space.

U.S. Pat. No. 4,216,467, Colston, Aug. 5, 1980, also teaches a 6 degree of freedom hand controller. However, once again, the handgrip member 10 is not spherical in shape but is rather somewhat cylindrical in shape. In addition, Colston uses push buttons and levers to achieve the 6 degree of freedom.

U.S. Pat. No. 4,012,014, Marshall, Mar. 15, 1977, teaches an aircraft flight controller which uses a handgrip member which, once again, is not spherical in shape.

The hand controllers above-discussed, and others available in the art, are not particularly useful for a fully suited astronaut. Typically, a spacesuit operates with a pressure differential between inside and outside of $3\frac{1}{2}$ psi. The pressure itself, the construction of the suit and more specifically, the gloves required to resist this pressure cause a loss in dexterity to the astronaut. This condition is further aggravated by the addition of radiation shielding required for protection. To grip a conventional handle of the type illustrated in the above U.S. patents for any length of time becomes extremely to tiring due to the natural characteristic of the gloves return to their neutral position. Therefore, it is necessary to design a handle which requires minimum movement from the neutral position yet which can still be positively gripped by a fully suited astronaut.

SUMMARY OF INVENTION

It is therefore an object of the invention to provide a hand controller which overcomes the above problems of the prior art.

It is a still further object of the invention to provide a hand controller for flight and/or manipulator control.

It is a still further object of the invention to provide a 6 degree of motion hand controller.

It is a still further object of the invention to provide a hand controller having a handgrip member which is substantially spherical and which has a substantially central point therein such that rotational motion inputs are provided by rotating the handgrip member about the point, translational motion inputs are provided such that the effective lines of thrust are through the point.

In accordance with a particular embodiment of the invention, there is provided a 6 degree of freedom hand controller. The hand controller includes a handgrip member which is substantially spherical in shape and which includes a point disposed substantially centrally of the member. An elongated shaft member supports the handgrip member such that the handgrip member is rotatable, from an initial position, about the point. The rotational motion of the handgrip member about the point is resolvable into motion about a pitch axis, passing through the point, a roll axis at right angles to the pitch axis and also passing through the point, and a yaw axis, at right angles to both the pitch axis and the roll axis and also passing through the point. The elongated shaft member is movably supported such that the handgrip member is movable, from the initial position, in translational motion resoluable into motion along the pitch, roll and yaw axes and through the point. Whereby, the rotational motion of the member comprises motion of the member about the point, and, whereby, the effective lines of thrust of the translational motion of the member pass through the point.

BRIEF DESCRIPTION OF DRAWINGS

The invention will be better understood by an examination of the following description together with the accompanying drawings in which.

DESCRIPTION OF PREFERRED EMBODIMENTS

Figure 1:
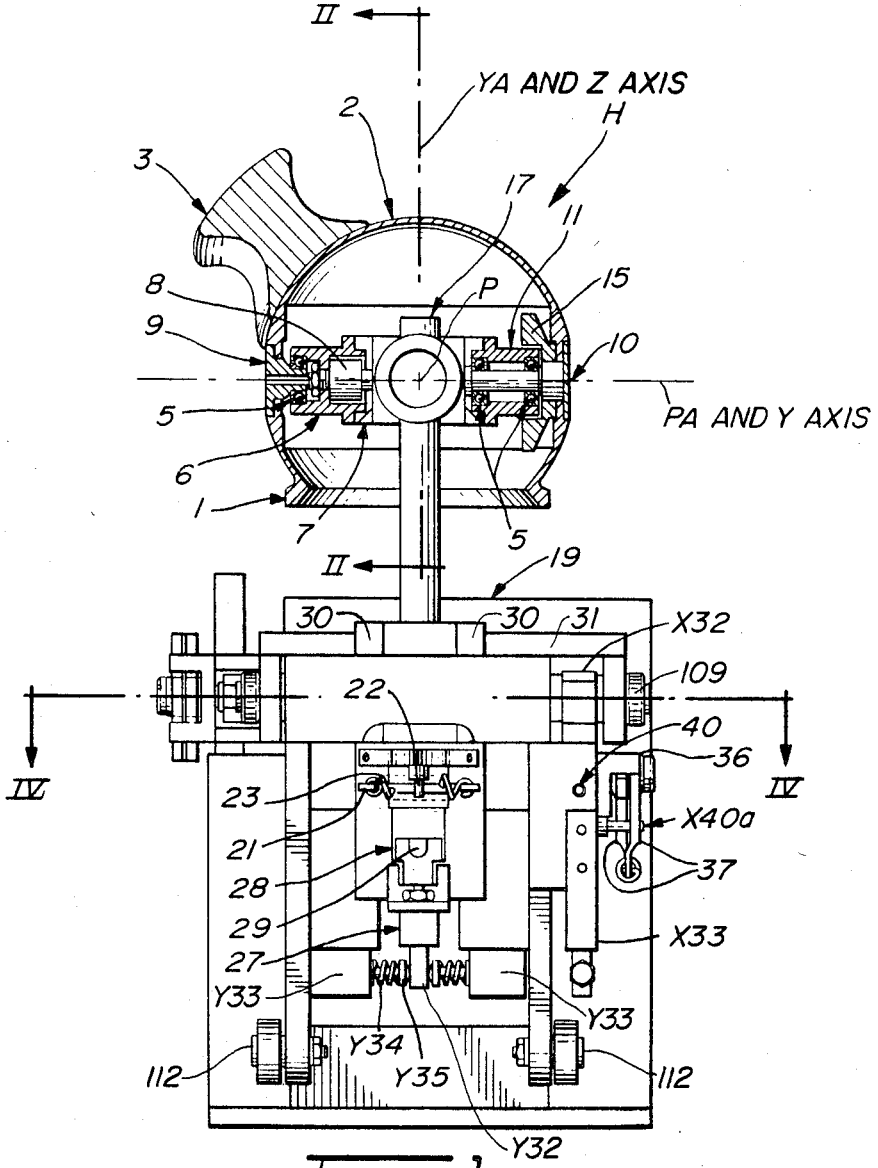
FIG. 1 is a front view of the hand controller in accordance with the invention with the handgrip member being a cross-section through I—I of FIG. 2.

Referring to the drawings, the handgrip, designated generally as H, is substantially spherical and is made in two parts, the grip base 1 and the cap 2. The cap is symmetrical and provides mounting for the butt 3. By rotating the cap 180° and rotating the butt about its center line, the handgrip can be adjusted for left or right hand operation. A horizontal depression 4 surrounds the grip base at the center to act as a reference point for the fingertips.

Figure 7:
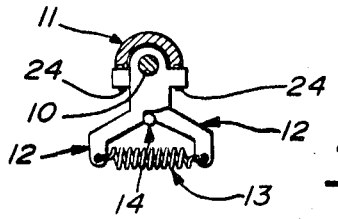
FIG. 7 is a scrap view of the roll and pitch axis load arm 12 of FIG. 3.
Figure 3:
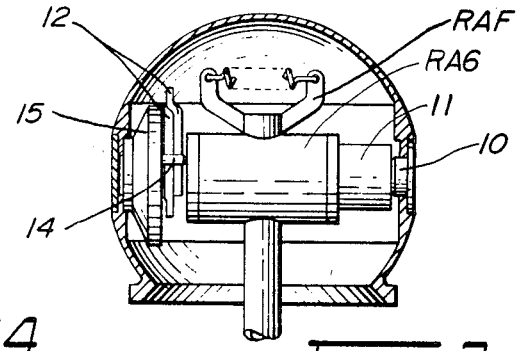
FIG. 3 is a section through III—III of FIG. 2.

The grip base is supported on and rotatable, about the pitch axis PA, on pitch axis bearings 5. (See FIG. 1). The pitch axis bearing is supported by the transducer housing 6 which in turn is supported by the pitch axis gimbal frame 7. The transducer 8, supported in transducer housing 6, is concentric with the pitch axis PA and is driven by the handgrip support shaft 9. The right handgrip support shaft 10 is supported by its bearing and by the force feel housing 11 which in turn is supported by the pitch axis gimbal 7. The support shaft 10 provides the axis for the two load arms 12 (see FIGS. 3 and 7) which are linked by spring 13. Drive from the handgrip to the load arms is via the drive pin 14 whose support 15 is driven by the handgrip. The force feel assembly operation is the same as described below with relation to the yaw axis.

Figure 2:
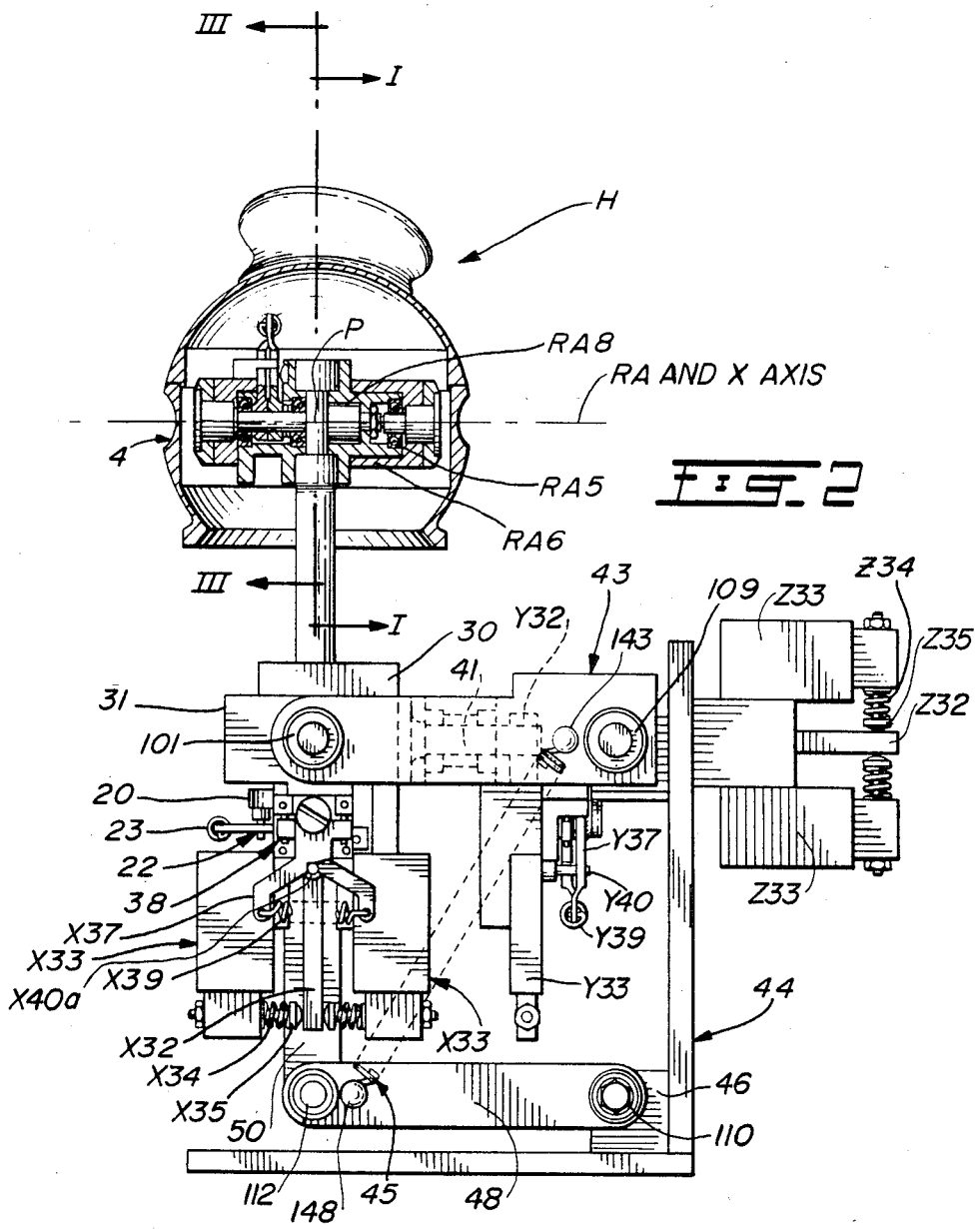
FIG. 2 is a side view of the hand controller with the handgrip member being a section through II—II of FIG. 1

As will be appreciated, the above-described assembly permits rotation of the handgrip member about the pitch axis PA, and the transducer 8 detects the degree of rotation of the handgrip member about this axis. A similar assembly is provided for permitting rotation of the handgrip member about the roll axis, and for detecting the degree of rotation about the roll axis. The assembly is illustrated in FIG. 2 which shows the roll axis bearing RA5 supported in the roll axis transducer housing RA6 which is in turn supported by the roll axis gimbal frame RA7. Transducer RA8 determines the degree of rotation of the handgrip member about the roll axis RA. A feel force assembly, similar to the feel force assembly for the pitch axis, is also provided for the roll axis and is illustrated at RAF in FIG. 3.

Figure 4:
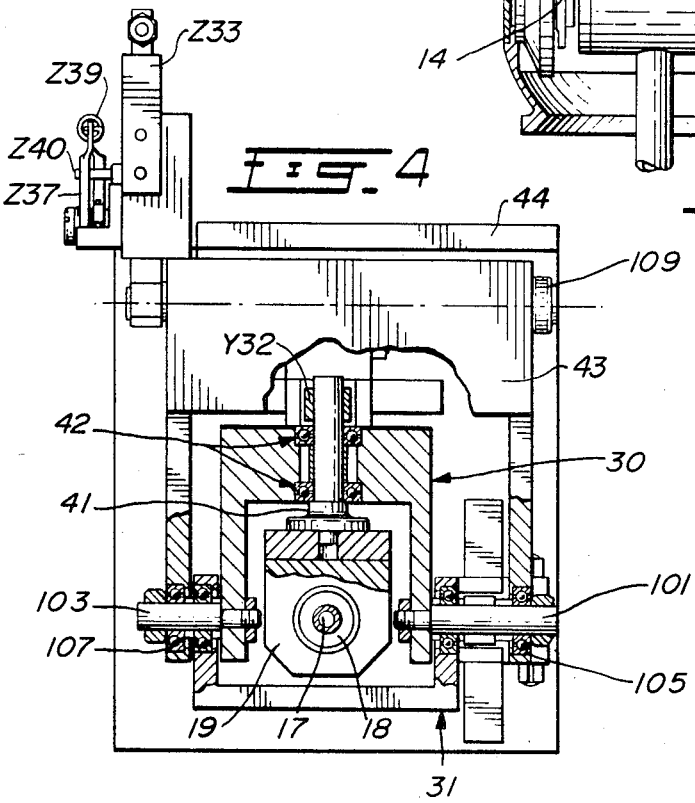
FIG. 4 is a section through IV—IV of FIG. 1.
Figure 5:
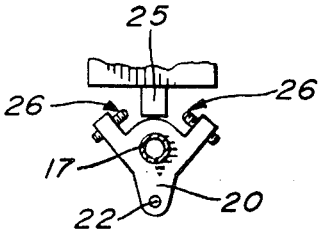
FIG. 5 is a scrap view of drive arm 20 in FIG. 2.
Figure 6:
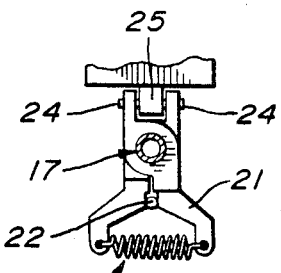
FIG. 6 is a scrap view of load arm 21 in FIG. 1.

The roll axis assembly is supported in an opening in yaw axis support shaft 17. (See FIG. 2). The support shaft 17 is supported in yaw bearings 18 housed within yaw bracket 19 as best seen in FIG. 4. Yaw axis drive arm 20 (see FIG. 2) is attached 21 rigidly to the support shaft and drives the load arms (see FIG. 6) via the drive pin 22. Spring 23 connects the ends of the load arms which are free to rotate on the support shaft. The opposite ends of the load arms have adjustment screws 24 which bear against the stop block 25. The adjustment screws are used to set the free play (null) between the load arms and the drive pin. A displacement of the handgrip in yaw beyond the null limit causes the drive pin to displace one arm creating a return force via the spring and the other load arm with its adjustment bearing against the stop block. Thus, the handgrip member will automatically be returned to its null position when force on the handgrip member is released. The feel force assemblies for both the pitch axis and the roll axis are similarly structured.

The drive arm 20 has lobes containing end stop adjustment screws 26 which, by acting against the stop block, restrict the travel in the yaw axis.

Yaw axis transducer 27 (see FIG. 1), mounted concentric with yaw axis YA, is driven by the support shaft via the adaptor 28. This adaptor has an exit port 29 to allow wiring from the roll and pitch transducers to exit from the hollow support shaft. For the sake of clarity, the wiring has not been shown.

It can be seen that this design uses passive feedback only, i.e., increasing load for increasing output, and is therefore self-nulling in all axes. The null position identification is provided in all axes. Specifically, the null is identifiable by a small free movement. In order to break out of the null a preloaded spring has to be overcome.

Preferably, these transducers will comprise load cells or strain gauges, although rotary potentiometers may also be used. Load cells are preferably of the type identified by the designation MB-25 of Interface, Inc.

Although motion of the three rotational axes has been separately described, the operator will not necessarily rotate the handgrip member through one axis at a time. However, the rotation of the handgrip member by the operator will always be resolvable into pitch roll and yaw axes.

The hand controller in accordance with the invention is also provided with assemblies for translational motion. The basic operating principle is the same in each of the three translational axes and hence will be described for one axis only.

In the case of the X axis (parallel to the roll axis) translation, the relative motion and load transmission is measured between yoke 30 and vertical stabilizer 31 (see FIGS. 2 and 4). The yoke is supported via two shafts 101 and 103 which are rigidly bolted to it. Bearings 105 and 107 for the respective shafts are housed in the vertical stabilizer, and hence the shaft is free to move relative to the vertical stabilizer. Although the motion of the handgrip member is an arc with its center at shafts 101/103, because of the relatively large radius of this arc, the feel to the operator will be that of translational motion.

Load arm 32 is a close fit on the shaft 17 and is pinned to it. Two load cells 33 are used on each axis, one to sense motion in each direction (backwards and forwards). Load is applied to the cells via preloaded springs 34. The springs are set such that clearance exists between the buttons 35 and the load arm. (Note—load arms, load cells, springs, buttons, etc. are labelled in accordance with their respective axes. Thus, for example, load cells X33, Y33 and Z33 are the load cells in the X, Y and Z axes respectively while X35, Y35 and Z35 are the buttons of the X, Y and Z axes respectively.

The null break out mechanism (feel force assembly) is mounted across the load cell mounting on a bracket 36 and consists of two load arms 37 with end stop adjustments 38 and a preload spring 39. The arms control the movement of the pin X40 which is integral with the load arm X32.

A similar arrangement is provided for the Y axis, which is parallel to the pitch axis, however, only the preloaded springs Y34 and the buttons Y35 are shown in FIG. 1.

In operation, the null is adjusted using the load arm adjustments such that the desired clearance exists between the pin and the arms permitting limited movement of the handgrip member without output. To produce an output, load is applied to the handgrip member. As the load exceeds the break out limit of the spring 39, the load arm moves out of the null position and in so doing makes contact with the button 35. Increasing load applied to the handgrip member will then produce an output from that load cell proportional to the applied load without further detectable movement of the handgrip member up to the point where the maximum system rate has been commanded (soft stop). If more load is applied, then the preload in the spring 34 will be exceeded and the handle will travel to the limit of the end stops (or hard stop) adjusted by screws 40.

As above-mentioned, the same mechanism as described above is used in the Y and Z axes. In the case of the Y axis, the relative motion and load transmission is measured between the yoke 30 and the yaw Y bracket 19 via the support shaft 41 which is supported in bearings 42 within the yoke. (See FIG. 4). As mentioned, only springs Y34 and Y35 are illustrated in FIG. 1.

For the Z axis, which is parallel to the yaw axis, relative motion between the main support yoke 43 and fixed base of the assembly 44 about the main support shaft 109 is sensed. Spring 45 (see FIG. 2) is a long low rate spring means which counteracts gravity to balance the Z travel in the null position. For zero g operation, the spring 45 would be removed. Spring 45 is attached, at its bottom end, to knob 143 of support yoke 43 and, at its bottom end, to knob 148 of horizontal link 48, which is supported by vertical link 50. The horizontal link pivots relative to block 46 about pivot point 110, while vertical link 50 pivots relative to horizontal link 48 about pivot point 112.

As can be seen, the axes in the inventive hand controller are positioned to coincide with the natural axes of the human hand and wrist. All rotational axes pass through a common point P in FIGS. 1 and 2, and the effective lines of thrust for the translational inputs also pass through the same point, P. Hence, the possibility of cross talk or inadvertent inputs is substantially eliminated.

Once again, the operator will not necessarily move the handgrip member through one translational axis at a time. Thus, he might move it diagonally forward and upward. However, all of the translational motion of the handgrip member by the operator is resolvable into the three translational axes.

In order to assist the operator in applying the desired inputs, it is necessary to avoid any confusion between axes, i.e., rotation should be true rotation about an identifiable point and translation should be true translation rather than a noticeable rotation about an offset axis. The present design achieves this as follows: firstly, all rotational axes pass through the common point P located substantially in the center of the handgrip. Secondly, the translational inputs are achieved by varying pressure only with travel limited sufficient to detect the central of null position, and to give a clear indication of maximum input. Since the movements are minimal and take place about a relatively large radius, they appear translational.

A problem exists in relation to the fundamentally different modes of control required for spacecraft flight versus control of manipulators.

If we consider the use of rate (or velocity) control of the manipulator, then rate control is possible since the manipulator will have a fixed point or reference from which to operate in the rate control made in all axes. When manoeuvering a spacecraft, no such fixed reference point exists. For the simplest system, manoeuvering is achieved by firing thrusters in short burst thereby establishing different rate, i.e., a controller deflection causes acceleration.

Systems do now exist for rate control over three rotational degrees of freedom by establishing fixed reference points from which to measure rate of rotation. For example, in earth orbit, the horizon can be used, or distant star patterns can be used as reference in (deep) space.

However, no such reference system can be established for rate control of translation and as a consequence only acceleration control can be used at the present time.

Therefore, the design of the present hand controller has been established such that control of the three rotational axes is basically rate control whereas in the translational mode, either rate or acceleration can be used without any physical change to the input.

When used for spacecraft-like control the following assumptions are made:

(a) that in rotation either rate control or acceleration control or a combination of both using soft and hard stops would be available.

(b) that in translation, only acceleration control would be used, with or without stepped thrust levels.

In the rotational mode, if only acceleration control is available, then this would be achieve by deflecting the handgrip member in the desired axis or combination of axes, into the hard stop(s).

Where simple rate control is available, then the commanded rate would be proportional to handgrip pressure from break out up to a maximum at the hard stop limit.

Where a combination of rate and acceleration is available, such as in the Space Shuttle, then a soft stop would be incorporated into each rotational axis. Displacement of the handgrip from break out to the soft stop limit would command a rate proportional to that displacement.

Further displacement of the handgrip member beyond the soft stop into the hard stop would command rotational acceleration.

For translational control, if single thrust levels are available in each axis, then movement of the handgrip member beyond the soft stop into the hard stop would command acceleration.

If variable throttled thrusters were used, then commanded thrust would be proportional to load applied to the handgrip member in the desired direction, up to a maximum where the soft stop is exceeded.

Manipulator Control

Two situations can exist, one where a specific unit is only used for control of a manipulator, and the other where the same controller is used to fly a spacecraft to, for example, a work station, and is then used to operate a manipulator.

In the first case, the control mode would be rate. For rotation, rate would be proportional to displacement from null break out to the hard stop. In translation rate would be proportional to applied load from break out up to a maximum where soft stop break out into displacement occurs. Beyond this soft stop the maximum rate would be maintained.

In the second case, there would be minor operational differences dependent upon the flight control system used. Where flight control is of simple acceleration, (or bang-bang thrust control) then, when used for manipulator control the operation would be the same as that described above.

When the spacecraft flight system has any form of rate control combined with acceleration control then each rotational axes will be equipped with a soft stop in addition to the hard stop. In this case, when controlling a manipulator, operation will be similar to that in translation, i.e. commanded rate will be proportional to handgrip displacement from break out to the soft stop and any further displacement into the hard stop will maintain maximum rate.

Use Beyond Low Earth Orbit

When flying in earth orbit it is assumed that, since all flight control is of a manoeuvering nondynamic nature, translational thrust in all three axes is the same, or similar.

However, in the case where a craft is designed to be capable of more extended use, e.g. transferring from a low orbit into a geo-syncronous orbit, or out of earth orbit altogether, then the thrust available for acceleration in one direction in one axis would be considerably higher. In such a case, the particular axis would be equipped with a double stage soft stop whereby break out from the first soft stop would command manoeuvering thrust only. Break out from the second soft stop would require high pressure and would command the high thrust level.

The use of a high force for this action would not be a disadvantage in space, because high acceleration of the craft will be taking place along the same force line as that in which the astronaut will be applying pressure. Since he will require restraint against the acceleration the same restraint will provide the reaction point for control load.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A 6 degree of freedom hand controller, comprising:

a handgrip member being substantially spherical in shape and including a point disposed substantially centrally of said member;

an elongated shaft member for supporting said handgrip member such that said handgrip member is rotatable, from an initial position, about said point, said rotational motion of said handgrip member about said point being resolvable into motion about a pitch axis, passing through said point, a roll axis at right angles to said pitch axis and also passing through said point, and a yaw axis, at right angles to both said pitch axis and said roll axis and also passing through said point;

said elongated shaft member being movably supported such that said handgrip member is movable, from said initial position, in translational motion resolvable into motion along said pitch, roll and yaw axes and through said point;

whereby, said rotational motion of sid member comprises motion of sid member about said point; and whereby the effective lines of thrust of said translational motion of said member pass through said point;

whereby translational motion is detected by movement of a shaft along a respective translational axis, said means for sensing translational motion comprising a pair of load cells, each one of said pair being disposed on a different side of said shaft in the direction of motion thereof, a spring between each said load cell and its respective shaft, and a button disposed at the free ends of each of said springs;

the space between said shaft and said button comprising the free play of the handgrip member along the respective translational axis;

whereby, when said handgrip member is moved so that said shaft touches said button, this comprises a soft stop; and when said shaft is moved so that the spring is no longer compressible in that direction, this constitutes a hard stop.

2. A controller as defined in claim 1 and further comprising separate means for sensing motion about each said roll, pitch and yaw axes and along the three translational axes, said means for sensing developing electrical signals representative of said motion.

3. A controller as defined in claim 1 and comprising means for returning said handgrip member to said initial position automatically when said handgrip member has been moved from said initial position.

4. A controller as defined in claim 3 wherein said means for returning said handgrip member having regards to motion about said rotational axes comprises, on each axis, a member, having two load arms movable relative to each other, the free ends of said load arms being joined by a spring, and adjustment means for limiting the motion of said arms by a hard stop.

5. A controller as defined in claim 1 and including means for supporting said handgrip member on said elongated shaft for permitting rotation of said handgrip member about said rotational axes comprises a shaft member, disposed in said handgrip member, along each respective one of said rotational axes, said shaft members being supported in bearings;

whereby to permit rotational motion of said handgrip member about said shaft.

6. A controller as defined in claim 1 and including a frame member;

said elongated shaft being supported for pivoting along said pitch, roll and yaw axes;

whereby said handgrip member is movable in translational motion along said pitch, roll and yaw axes.

* * * * *